United States Patent [19]

Ketterer

[11] 4,312,285

[45] Jan. 26, 1982

[54] HEM SECURING METHOD

[75] Inventor: Stanley J. Ketterer, Jamesburg, N.J.

[73] Assignee: The Singer Company, Stamford, Conn.

[21] Appl. No.: 249,059

[22] Filed: Mar. 30, 1981

[51] Int. Cl.[3] ..... D05B 1/24

[52] U.S. Cl. ..... 112/267.1; 112/158 R; 112/319

[58] Field of Search ..... 112/267.1, 266.1, 262.1, 112/69, 65, 158 R, 319

[56] References Cited

U.S. PATENT DOCUMENTS

| | | | |
|---|---|---|---|
| 2,369,470 | 2/1945 | Langa | 112/266.1 |
| 3,374,754 | 3/1968 | Gianinazzi | 112/158 R |
| 3,447,497 | 6/1969 | Rendahl | 112/158 R |
| 3,690,277 | 9/1972 | Baxter et al. | 112/267.1 |
| 3,859,941 | 1/1975 | Krieger | 112/266.1 |

*Primary Examiner*—H. Hampton Hunter

*Attorney, Agent, or Firm*—Edward P. Schmidt; Robert E. Smith; Edward L. Bell

[57] ABSTRACT

A hem securing method utilizing a narrow bight bar tack in which the bobbin thread appears on the outer face of the hemmed article. The hem is folded and needle penetrations take place from the inner side to draw a bobbin thread selected for a color match and without regard to stitch ability. A sequence of stitches is selected for the bar tack to enhance lock up of the threads so as to permit close trimming of the bar tack with lessened likelihood of unraveling.

6 Claims, 2 Drawing Figures

HEM SECURING METHOD

BACKGROUND OF THE INVENTION

This invention relates to improvements in hemmed articles and methods of making the same.

Presently, manufacture of a hemmed article is normally effected using an edge guide in a sewing machine having a blind stitch capability. In the usual fashion, a hem for a blind stitch is folded into a flat Z shape so that the ply in which the advance stitches are made is the turned under hem with lateral stitches being made into a doubled over edge in a fashion to have the least thread appear on the outer face of the work material. When careful preparations are made to fold the work material properly and to locate the blind stitch hem guide so that the minimum amount of thread shows on the finished surface, an entirely satisfactory hem is made. What is herein proposed is a simpler method which will provide a satisfactorily invisible seam in a sewing machine without the necessity for a blind stitch hem guide or the capability to accomplish a blind stitch.

SUMMARY OF THE INVENTION

A method is proposed for making a hem which does not require the use of a blind stitch hem guide, or of a sewing machine having a blind stitch capability. In the practice of this method, the material is reversed and the hem is folded as it would finally appear. A sewing machine may be utilized which has only a narrow bight zig zag capability. In this method, in its simplest form, the feeding rate for the sewing machine is set at zero and a bar tack is made. Thereafter, the material is shifted to a new location spaced from the first location and a second bar tack is implemented. This process is repeated, spacing the bar tacks from the edge of the turned up hem by eye, until the entire hem has been so completed. Thereafter, the material is restored to its proper orientation and the bobbin threads on the outside of the material are trimmed close in order to make these bar tacks less visible. In the method, the bobbin thread may be pulled up by adjusting needle thread tension so as to be the only thread showing. A thread can be selected for its closeness to the appearance of the fabric without regard to its compatability to use in the sewing machine, since the needle thread is the critical thread in the stitching operation. For the greatest invisibility, a length of bobbin thread could be unravelled from the fabric to be hemmed and wound upon a bobbin so as to obtain a near perfect match with a high degree of invisibility. For a sewing machine having basting stitch capability, material feed can be obtained between bar tacks without stitching to avoid manual repositioning of the work material.

BRIEF DESCRIPTION OF THE DRAWINGS

In order that the invention may be more fully understood, it will now be described, by way of example, with reference to the accompanying drawings in which:

In FIG. 1 there is shown, for example, a portion of an inner side of a cuff 20 in which the work material 21 is fashioned with an upper layer 22 folded back on itself to leave a finished appearing bottom edge 23. The upper layer 22 is the inner layer of the finished cuff 20. The cuff 20 as shown in FIG. 1, would be presented to a lockstitch sewing machine with the bottom layer 24 of the work material 21 supported on the work supporting bed thereof as is well known in the sewing machine art. The bottom layer 24 is the outer layer of the finished cuff 20. Thus, the sewing needle of the sewing machine would first penetrate the upper layer 22, and, in FIG. 1, the needle thread 25 is displayed thereon. A bobbin thread 27 (see FIG. 2) is selected for a color match to the work material 21 to provide the maximum degree of invisibility thereto. In fact, since the bobbin thread 27 is not involved with the stitching capability of the sewing machine, it is possible to remove a length of thread from the work material 21, to be wound upon a sewing machine bobbin so that a perfect match with the work material 21 may be obtained. In this way, even a difficult thread material, one in which considerable sewing difficulty is ordinarily encountered due to problems with loop formation, may be used.

Figure 1:
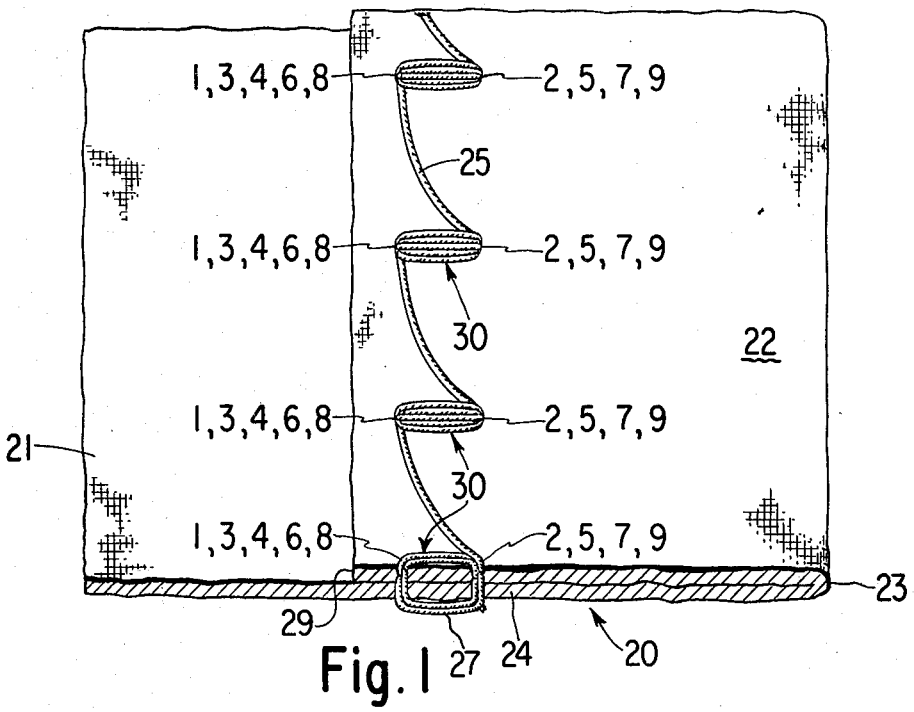
FIG. 1 is a plan view of a reverse side of a hem in which the method has been practiced indicating a preferred stitch sequence for locking of the bar tacks thus generated; and, FIG. 2 is a plan view of the outer side of the hem shown in FIG. 1 indicating the final appearance thereof.
Figure 2:
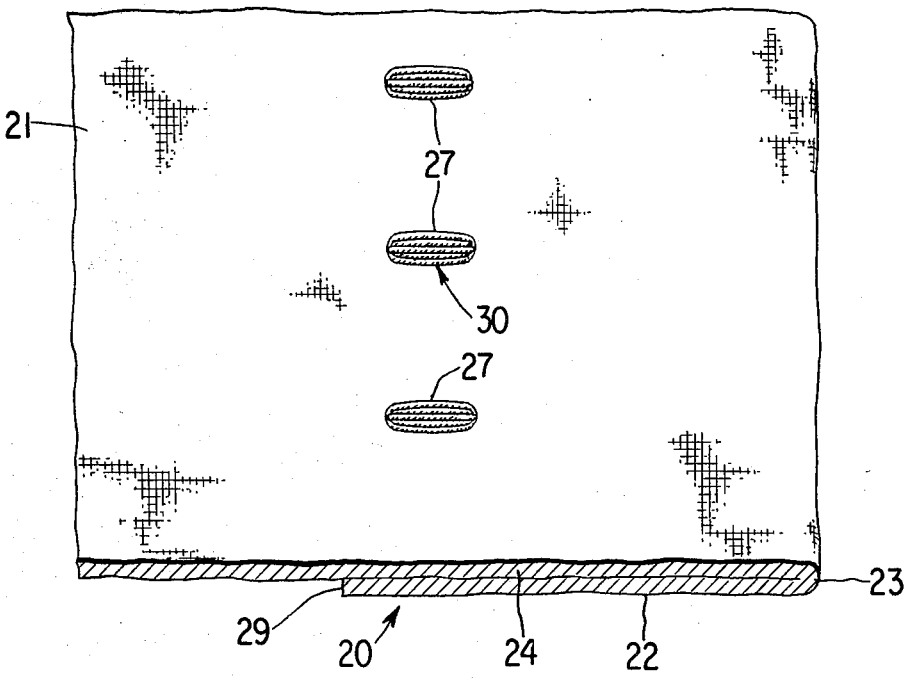

Referring back to FIG. 1, it is noted that the sewing machine may be set for a narrow bight in order to further decrease visibility of the bar tack 30 on the outside of the work material 21. In the bar tack 30, a specific stitch sequence may be followed so as to obtain a thread lock to deter subsequent unraveling. In the example shown, the first needle penetration takes place in the left needle position, with the second needle penetration in the right needle position, as indicated by the numbers adjacent those positions. Thus, it will be understood that the first, third, fourth, sixth and eighth needle penetration are in the left needle position, while the second, fifth, seventh and nineth needle penetration are in the right needle position, these penetrations being arranged so that the concatenation of the formed stitches will lock regardless of subsequent thread trimming. Left or right needle penetrations are made in the same or substantially the same opening as the prior penetrations because the sewing machine feed is set to provide zero motion. The bar tack 30 may be spaced from the material edge 29 by eye and without the necessity for utilizing a blind stitch edge guide. Succeeding bar tacks are spaced from each other a sufficient amount to insure their effectiveness in retaining the layer 22 to the work material 21 to maintain the cuff edge 23. Repositioning of the work material 21 may be accomplished manually by an operator who will cease sewing, raise the presser foot retaining the work material against the sewing machine work supporting bed, and shift the work material physically to a new location for a subsequent bar tack. Alternatively, this may be accomplished in a sewing machine having a basting stitch capability as well as a programming capability for the feed rate and needle position by providing for a permanent record which preserves the sequence of bar tack stitching at zero feed, together with a subsequent feeding rate while the needle penetration is held in abayance. For purposes of illustration, the bar tacks indicated in FIGS. 1 and 2 are relatively close but, it will be understood that a more suitable spaceing may be implemented.

After completion of a sequence of bar tacks 30 around the periphery of the cuff 20, the work material 21 may be arranged with its bottom layer 24 outermost to expose the bobbin threads 27. The bobbin thread 27 remaining between the bar tacks 30 may be clipped close to the bar tacks so that the finished product presents an appearance as shown in FIG. 2 with the matching bobbin threads nearly invisible on the work material 21. The bobbin threads may be clipped quite close to the bar tacks because of the lock up attained by the stitching sequence disclosed in FIG. 1. The needle threads 25 intermediate the bar tacks 30 may selectively be removed or retained at the operator's descretion. In order to insure that only bobbin thread 27 appears on the outer face of the work material 21, the needle thread tension for the sewing machine may be arranged so as to pull the bobbin thread 27 through to the reverse side of the work material, such that some bobbin thread would appear on the inside face shown in FIG. 1. It is apparent that, in order to achieve a stitch which is less visible, the width of the bar tack 30 be made as narrow as practicable. It may also be possible to utilize fewer than nine stitches, it only being required to use that number of stitches which will provide a secure lock up of the bar tack 30.

I claim:

1. A method for making a blind stitch hem on a work material with a lockstitch sewing machine having a feed system which may be nulled for a zero feed rate, a sewing needle, a needle thread forming an upper thread of said lockstitch, a tension device for said upper thread, a needle positioning system having at least a left and a right work material needle penetrating position, a work material supporting bed and a bobbin for carrying a lower thread for concatenation with said needle thread in the formation of said lockstitches, said method comprising the steps of:

a. selecting a lower thread for said bobbin for a close match with said work material;
b. nulling said feed system to obtain a zero feed rate;
c. setting said needle positioning system for a sequence of left and right needle positions;
d. folding a hem on said work material with an outside surface supported on said work material supporting bed and an inside surface facing said sewing needle;
e. stitching a bar tack spaced from the edge of the hem;
f. moving said work material preparatory to stitching a subsequent bar tack spaced from the preceding bar tack so as to maintain said hem and spaced from the edge of the hem an amount substantially identical to the preceding bar tack;
g. repeating steps e and f along the entire extent of the hem; and,
h. trimming bobbin thread extending between said bar tacks on the outside surface of said hem.

2. A method as claimed in claim 1 comprising the further step of:

i. setting said tension device for said upper thread so as to draw said bobbin thread through said work material.

3. A method as claimed in claim 1 wherein said sequence of stitches may include repeat penetrations in a side of said bar tack in order to obtain a stitch lock up to forestall unraveling of said bar tack.

4. A method as claimed in claim 3 wherein said sequence of stitches comprises the first, third, fourth, sixth and, eight stitch in one side of said bar tack, and the second, fifth, seventh and nineth stitch in the other side of said bar tack.

5. A method as claimed in claim 1 wherein said lower thread for step a is obtained by pulling a thread from said work material.

6. A method for making a blind stitch hem on a work material with a lockstitch sewing machine having a feed system which selectively may be nulled for a zero feed rate and may be set for a forward feed rate, a sewing needle, a needle thread forming an upper thread of said lockstitch, a needle positioning system having at least a left and a right work material needle penetrating position, a work material supporting bed, a bobbin for carrying a lower thread for concatenation with said needle thread in the formation of said lockstitches, and means for selectively holding stitching in abeyance, said method comprising the steps of:

a. selecting a lower thread for said bobbin the color of said work material;
b. setting said needle positioning system for a selected sequence of left and right needle positions;
c. fashioning a hem on said work material with an outside surface supported on said work material supporting bed and an inside surface facing said sewing needle;
d. stitching a bar tack spaced from the edge of the hem with said feed system nulled to obtain a zero feed rate;
e. actuating said means for selectively holding stitching in abeyance while regulating said feed system to obtain a forward feed rate so as to reposition said work material preparatory to stitching a subsequent bar tack spaced from the preceding bar tack so as to maintain said hem and spaced from the edge of the hem an amount substantially identical to the preceding bar tack;
f. repeating steps d and e along the entire extent of the hem; and,
g. trimming bobbin thread extending between bar tacks on the outside surface of said hem.

* * * * *